United States Patent [19]

Hayashi

[11] Patent Number: 4,520,771

[45] Date of Patent: Jun. 4, 1985

[54] INTERNAL COMBUSTION ENGINE

[75] Inventor: Yoshimasa Hayashi, Kamakura, Japan

[73] Assignee: Nissan Motor Co., Ltd., Yokohama, Japan

[21] Appl. No.: 544,206

[22] Filed: Oct. 21, 1983

[30] Foreign Application Priority Data

Oct. 26, 1982 [JP] Japan ..... 57-162235[U]

[51] Int. Cl.[3] ..... F02F 7/00

[52] U.S. Cl. ..... 123/195 H; 123/195 R; 123/195 C; 384/429; 384/432

[58] Field of Search ..... 123/195 R, 195 C, 198 E, 123/195 A, 195 S, 195 H; 384/429, 432, 434

[56] References Cited

U.S. PATENT DOCUMENTS

| | | | |
|---|---|---|---|
| 1,299,709 | 4/1919 | Hall | 92/161 |
| 1,399,001 | 12/1921 | Brownback | 384/432 |
| 1,916,292 | 7/1933 | Woolson | 123/195 H |
| 2,334,916 | 11/1943 | Ford et al. | 123/195 H |
| 4,071,008 | 1/1978 | Skatsche et al. | 123/195 C |
| 4,388,899 | 6/1983 | Shimada et al. | 123/195 C |

FOREIGN PATENT DOCUMENTS

| | | | |
|---|---|---|---|
| 0058949 | 9/1982 | European Pat. Off. . | |
| 1954318 | 11/1970 | Fed. Rep. of Germany . | |
| 2922030 | 12/1979 | Fed. Rep. of Germany . | |
| 0397322 | 8/1933 | France | 384/429 |
| 1583059 | 10/1969 | France . | |

*Primary Examiner*—Craig R. Feinberg
*Assistant Examiner*—David A. Okonsky
*Attorney, Agent, or Firm*—Schwartz, Jeffery, Schwaab, Mack, Blumenthal & Koch

[57] ABSTRACT

An internal combustion engine comprises a cylinder block having a plurality of main bearing bulkheads, and a skirt section. Each bearing bulkhead is formed with through-holes each of which as an upper end opening to the skirt section and a lower end opening to the bottom surface of the bearing bulkhead. The bearing bulkhead is formed at its bottom surface with a depression. Each of a plurality of bearing caps is installed to the bearing bulkhead in a manner to fit in the bearing bulkhead depression. Additionally, bolts are disposed respectively in the bearing bulkhead through-holes, each bolt having an upper end section located on the skirt section and a lower end section located in the hole formed in the bearing cap, thereby eliminating the need for excess structure on the bearing cap to sharply reduce the weight of the bearing cap.

10 Claims, 5 Drawing Figures

INTERNAL COMBUSTION ENGINE

BACKGROUND OF THE INVENTION

1. Field of the Invention

This invention relates, in general, to an improvement in an internal combustion engine, and more particularly to a bearing cap installation arrangement of an automotive engine intended to effect engine noise reduction.

2. Description of the Prior Art

In connection with conventional automotive internal combustion engines, a crankshaft is rotatably supported by bearing caps which are secured to the bottom section of a cylinder block by means of cap bolts. The cap bolts are passed through the bearing caps and screwed in the cylinder block bottom section, and therefore the bolt head of each cap bolt is located on the bottom surface of the bearing cap. In this regard, the bearing cap is required to have shoulder portions serving as seats for the cap bolt heads. This considerably increases the weight of the bearing cap, thereby readily causing vibration of the bearing caps. The thus caused bearing cap vibration excites the vibration of a cylinder block skirt section connected to the bearing caps and of an oil pan, thereby emitting considerable noise.

SUMMARY OF THE INVENTION

An internal combustion engine according to the present invention comprises a cylinder block having a plurality of main bearing bulkheads, and a skirt section integral with the bulkheads. Each bearing bulkhead is formed with first and second through-holes, each having a first end opened to the skirt section, and a second end opened to the bottom surface of the bearing bulkhead. The bearing bulkhead is formed at its bottom surface with a depression. A plurality of bearing caps are installed respectively to the bearing bulkheads. Each bearing cap fits in the bearing bulkhead depression and formed with first and second holes in alignment with the first and second through-holes, respectively. Additionally, first and second bolts are disposed respectively in the first and second through-holes, each bolt having a first end section located on the skirt section, and a second end section disposed in the hole of the bearing cap.

Therefore, each bearing cap does not require the shoulders serving as seats for the bolt heads of the bolts connecting the bearing cap with the cylinder block, thereby sharply reducing the weight of the bearing cap. This suppresses the vibration of the bearing caps and therefore prevents the cylinder block skirt section and the oil pan from vibrating, thus effectively reducing noise emission from the engine.

BRIEF DESCRIPTION OF THE DRAWINGS

The features and advantages of the internal combustion engine according to the present invention will be more clearly appreciated from the following description taken in conjunction with the accompanying drawings in which like reference numerals designate like parts and elements, in which.

DETAILED DESCRIPTION OF THE INVENTION

Figure 1:
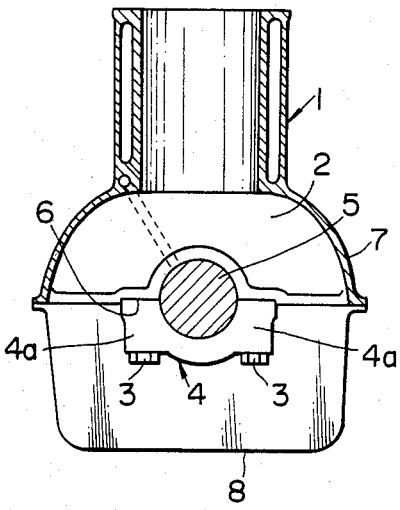
FIG.1 PRIOR ART
FIG. 1 is a vertical cross section of an essential part of a conventional automotive internal combustion engine, particularly showing a bearing cap installation arrangement.
Figure 2:
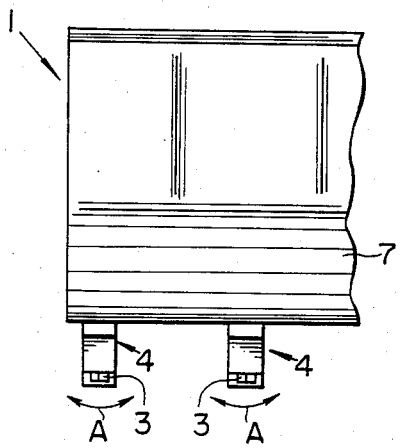
FIG.2 PRIOR ART
FIG. 2 is a fragmentary side elevation of the engine essential part of FIG. 1.

To facilitate understanding the present invention, a brief reference will be made to an example of conventional automotive internal combustion engines, depicted in FIGS. 1 and 2. Referring to FIGS. 1 and 2, the conventional engine includes a cylinder block 1 which has a plurality of main bearing bulkheads 2 to which bearing caps 4 are secured, respectively, by bolts 3. A crankshaft 5 is rotatably supported between each bearing bulkhead 2 and each bearing cap 4 through bearing elements. Each bearing cap 4 is located in a depression 6 formed at the bottom surface of the bearing bulkhead and fixed there by means of two cap bolts which perpendicularly pass through the bearing cap 4 at the opposite side sections.

However, with the above-mentioned engine configuration, in order to attain seats to which the bolt heads of the cap bolts are seated, it is required to form enlarged shoulder sections 4*a* of the bearing cap 4 which are excess weight from a point of view of support strength of the bearing metal, thereby increasing the weight of the bearing cap 4. Accordingly, the bearing cap 4 tends to easily vibrate in the direction of arrows A as shown in FIG. 2, which is the major cause of lateral (open-and-close) vibration of the skirt section 7 and secondary vibration of the oil pan 8. Such vibration of the bearing cap 4 is predominant within a range of 1 to 2 KHz which is critical as engine noise, thus emitting high level noise from the cylinder block skirt section 7 and the oil pan 8.

Figure 3:
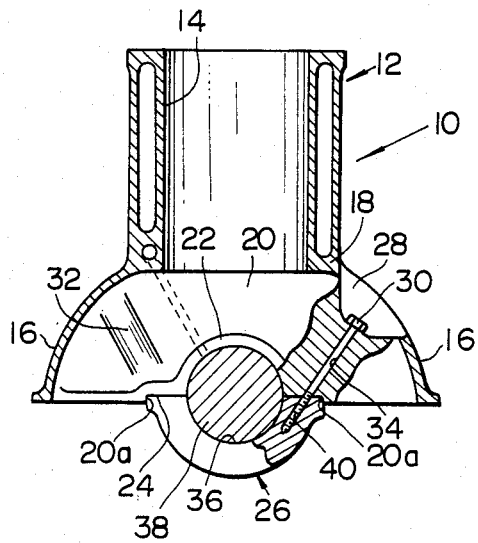
FIG. 3 is a vertical cross section of an essential part of a preferred embodiment of an automotive internal combustion engine in accordance with the present invention, particularly showing a bearing cap installation arrangement according to the present invention.
Figure 4:
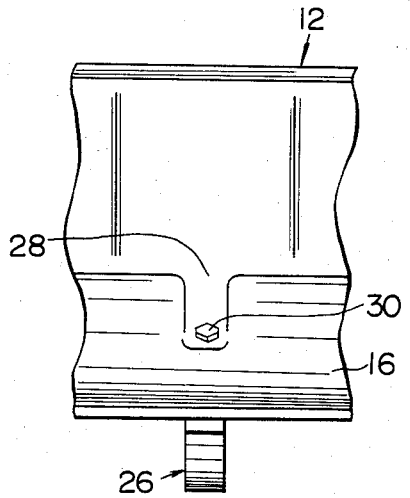
FIG. 4 is a fragmentary side elvation of the engine essential part of FIG. 3.
Figure 5:
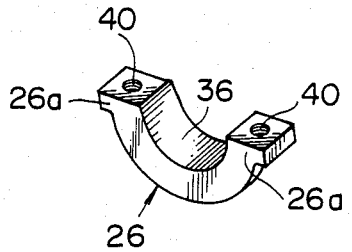
FIG. 5 is a perspective view of a bearing cap forming part of the engine of FIG. 3.

In view of the above description of the conventional engine, reference is now made to FIGS. 3, 4 and 5, wherein a preferred embodiment of an internal combustion engine according to the present invention is illustrated by the reference numeral 10. The engine 10 in this instance is used for an automotive vehicle and comprises a cylinder block 12 which is formed with a plurality of cylinder barrels 14 each of which defines therein a cylinder bore (no numeral). The cylinder block 12 includes a so-called skirt section 16 which is bulged outwardly and extends downwardly to define thereinside the upper part of a crankcase (no numeral). The skirt section 16 is integrally connected through a lower block deck 18 with the cylinder barrels 14. A plurality of main bearing bulkheads 20 are parallelly disposed inside of the skirt section 16 in a manner to divide the inside of the skirt section into a plurality of chambers. Each bearing bulkhead 20 is located below and connected to a portion between the adjacent two cylinder barrels 14. The bearing bulkhead 20 is integrally connected at its top part with the lower block deck 18 and at its side parts with the inner wall surface of the skirt section 16. Each bearing bulkhead 20 is provided at its bottom central portion with a semicylindrical bearing carrying section 22, and formed at its bottom surface with a depression 24 for the purpose of locating a bearing cap 26 in position. As shown, the opposite sides of the depression 24 are defined by opposite vertical side walls 20*a*, 20*a* of the bearing bulkhead 20; and the bearing cap 26 is located between these opposite vertical side walls 20*a*, 20*a* so that the opposite side surfaces of bearing cap 26 contact respectively with the opposite vertical side walls 20*a*, 20*a*.

The skirt section 16 is formed at its upper section with a plurality of depressions 28 which are located respectively at portions corresponding to the bearing bulkheads 20. The surface of the skirt section 16 defining the depression 28 serves as a seat for the head of a bolt 30 which securely connects the bearing cap 26 with the bearing bulkhead 20. The bearing bulkhead 20 is provided with ribs 32 which are formed by partially increasing the thickness of the casting of the bearing bulkhead 20. Each rib 32 extends in the direction from the bearing bulkhead depression 24 to the skirt section depression 28. Formed in the rib 32 is a through-hole 34 which extends to connect the bearing bulkhead depression 24 and the skirt section depression 28. In other words, one end of the through-hole 34 opens to or merges in the bearing bulkhead depression 24 while the other end thereof opens to or merges in the skirt section depression 28. The through-hole 34 is formed by reaming and located inclined relative to an imaginary vertical plane containing the axes (not shown) of the cylinder bores. Disposed within the through-hole 34 is the bolt 30 for fixedly connecting the bearing cap 26 with the bearing bulkhead 20.

The bearing cap 26 is generally semicylindrical and formed at its inner surface with a semicylindrical bearing carrying section 36 which rotatably supports the journal of a crankshaft 38 in cooperation with the bearing carrying section 22 of the bearing bulkhead 20. More specifically, the bearing cap 26 is in such a shape that the inner and outer semicylindrical surfaces thereof are generally coaxial with each other so that the thickness thereof is generally the same along the arcuate longitudinal direction thereof. The thickness of the bearing cap 26 is made as small as possible within a range sufficient to withstand combustion impact force applied through pistons (not shown). Additionally, the opposite end sections 26*a* (in FIG. 5) of the bearing cap 26 are formed generally into the shape of rectangular parallelepiped, and are formed respectively with threaded holes 40, 40 which meet with and are in alignment with the through-holes 34, 34, respectively.

Thus, after being located in position, the bearing cap 26 is fixed to the bearing bulkhead 20 by screwing the threaded end section of the bolt 30 into the threaded hole 40 of the bearing cap 26 upon inserting the bolt 30 into the through-hole 34 of the bearing bulkhead 20. In this state, the head of the bolt 30 is located within the depression 28 of the skirt section 16.

With the thus arranged engine, the bearing cap 26 does not require the excessive structure serving as the seat for supporting the bolt head; and the threaded hole 40 of the bearing cap 26 extends generally along the arcuate direction of the generally semicylindrical bearing cap 26. This sharply reduces the weight of the bearing cap as compared with that in conventional engines, in order to obtain the same flexural rigidity of the bearing cap 26 itself and the same connection strength of the bearing cap with the cylinder block 11 as in the conventional engine. Accordingly, the bearing caps 26 are improved in dynamic stiffness against vibration applied in the direction to cause the bearing cap 26 to come down or in the direction of the arrows A shown in FIG. 2. This also raises the natural frequency of the bearing cap 26 over the range of 1 to 2 KHz which is critical as engine noise, and lowers the vibration level of the bearing cap 26, thereby effectively suppressing the vibration of the skirt section 16 and an oil pan connected to the skirt section. As a result, noise emission from the cylinder block skirt section is sharply reduced.

Furthermore, the depression 28 partially formed at the skirt section 16 contributes to an improvement in rigidity of the skirt section 16, thus suppressing membrane vibration of the skirt section 16. This further reduces engine noise.

Moreover, increasing tightness of the bolt 30 for connecting the bearing cap 26 with the cylinder block 12 can be easily accomplished from the outside of the engine when the bolt is loosened, without removing the oil pan. In this connection, removing an oil pan is necessary to increase the tightness of cap bolts in conventional engines.

Additionally, although force due to tightening the bolt 30 so acts on the bearing cap 26 that the distance between the opposite end sections 26*a*, 26*a* increases, the deformation of the bearing cap 26 is effectively prevented because of the bearing bulkhead depression 24 to which the bearing cap 26 tightly fits, thus never obstructing bearing function of the bearing cap 26.

As is appreciated from the above, with the thus arranged engine according to the present invention, the bearing cap is sharply reduced in weight and improved in dynamic stiffness, greatly suppressing the vibration of the bearing caps within a frequency range of 1 to 2 KHz which is critical as engine noise which vibration is a major source of the noise emission from the cylinder block skirt section, the oil pan and their vicinity. This achieves a further noise reduction of the engine.

What is claimed is:

1. An internal combustion engine comprising:

a cylinder block including a plurality of integral main bearing bulkheads, and an integral skirt section;

means defining first and second through-holes formed in each bearing bulkhead, each through-hole having a first end opened to said skirt section, and a second end opened to a bottom surface of said bearing bulkhead, an axis of each through-hole being inclined relative to a vertical plane containing an axis of a crankshaft;

means defining a depression at the bottom surface of said bearing bulkhead;

a plurality of bearing caps each of which fits in said depression and is generally semicylindrical, each bearing cap being formed with first and second threaded holes which are aligned with said first and second through-holes, respectively, an axis of each threaded hole being inclined relative to said vertical plane and extending straight and substantially along the curvature of said bearing cap; and first and second bolts disposed respectively in said first and second through-holes, each bolt having a first end section located in said through-hole of said skirt section, and a second end section which is threaded and screwed in a respective one of said first and second threaded holes of said bearing cap, each bolt being dimensioned to extend through its respective through-hole and terminate in its respective threaded hole.

2. An internal combustion engine as claimed in claim 1, wherein said bearing cap has arcuate inner and outer surfaces which are coaxial with each other.

3. An internal combustion engine as claimed in claim 1, wherein said bearing bulkhead is formed with first and second ribs which define therein said first and second through-holes, respectively.

4. An internal combustion engine as claimed in claim 1, wherein said bearing bulkhead depression is defined by opposite vertical walls between which said bearing cap is tightly disposed.

5. An internal combustion engine as claimed in claim 1, wherein said first and second bolts are located inclined relative to said vertical plane containing axes of cylinder bores of said cylinder block.

6. An internal combustion engine as claimed in claim 5, wherein said first and second bolts are positioned symmetrically with respect to said vertical plane.

7. An internal combustion engine as claimed in claim 1, wherein the first end section of said bolt is formed with a bolt head while the second end section of said bolt is formed with a threaded portion engaged with the threaded bearing cap hole.

8. An internal combustion engine as claimed in claim 7, wherein said cylinder block skirt section is formed with a plurality of depressions at the locations corresponding to said bearing bulkheads.

9. An internal combustion engine as claimed in claim 8, wherein the first end of said through-hole merges in said skirt section depression while the second end of said through-hole merges in said bearing bulkhead depression.

10. An internal combustion engine as claimed in claim 9, wherein said bolt head is located within said skirt section depression.

* * * * *